US012352002B2

(12) United States Patent
Hall-Thompson et al.

(10) Patent No.: US 12,352,002 B2
(45) Date of Patent: Jul. 8, 2025

(54) UNDERGROUND CUBOID SULFUR STORAGE SYSTEMS

(71) Applicant: SAUDI ARABIAN OIL COMPANY, Dhahran (SA)

(72) Inventors: Bryan Hall-Thompson, Dhahran (SA); Humaid Ahmed Alhuthali, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 245 days.

(21) Appl. No.: 18/323,991

(22) Filed: May 25, 2023

(65) Prior Publication Data

US 2024/0392528 A1 Nov. 28, 2024

(51) Int. Cl.
*E02D 29/045* (2006.01)

(52) U.S. Cl.
CPC ..... *E02D 29/045* (2013.01)

(58) Field of Classification Search
CPC ..... E02D 29/045; E02D 29/05; E02D 29/055
See application file for complete search history.

(56) References Cited

U.S. PATENT DOCUMENTS

| | | | | |
|---|---|---|---|---|
| 3,705,851 | A | 12/1972 | Brauer | |
| 3,832,145 | A | 8/1974 | Ellithorpe et al. | |
| 4,139,347 | A | 2/1979 | Tse | |
| 4,335,978 | A | 6/1982 | Mutch | |
| 4,594,513 | A | 6/1986 | Suzuki et al. | |
| 4,696,599 | A | 9/1987 | Rakoczynski et al. | |
| 4,810,131 | A | 3/1989 | Turner | |
| 5,076,728 | A | 12/1991 | Golding | |
| 5,415,496 | A | 5/1995 | Denbesten | |
| 5,435,945 | A | 7/1995 | De Paoli et al. | |
| 5,820,298 | A * | 10/1998 | Dzierzbicki | B09B 1/00 405/270 |
| 6,241,423 | B1 | 6/2001 | Thomas | |
| 6,582,025 | B2 | 6/2003 | Pickren | |
| 6,599,058 | B1 | 7/2003 | Arnold | |
| 7,074,174 | B2 | 7/2006 | Lindgren | |
| 8,424,601 | B2 | 4/2013 | Betzer-Zilevitch | |
| 8,900,484 | B2 | 12/2014 | Barchasz et al. | |
| 9,090,839 | B2 | 7/2015 | Schaffer et al. | |
| 9,567,439 | B1 | 2/2017 | Pyun et al. | |

(Continued)

FOREIGN PATENT DOCUMENTS

| | | | |
|---|---|---|---|
| CA | 2551370 | A1 | 1/2007 |
| CN | 213591369 | U | 7/2021 |
| WO | 1998036856 | A1 | 8/1998 |

*Primary Examiner* — Rodney Mintz
(74) *Attorney, Agent, or Firm* — Vorys, Sater, Seymour and Pease LLP

(57) ABSTRACT

An underground storage unit for storing bulk sulfur includes a base layer comprising leachate collection pipes arranged to form a grid of cells, and high strength sulfur positioned at each cell, an intermediate layer comprising high strength sulfur side walls extending from a perimeter of the base layer, and bulk sulfur positioned on top of the base layer, a top layer positioned at an extent of the side walls and comprising a first sub-layer formed from high strength sulfur, a second sub-layer formed from a rigid moisture resistant material, and a third sub-layer formed from top soil, and one or more hatches positioned at the top layer that provide access to the bulk sulfur of the intermediate layer.

20 Claims, 7 Drawing Sheets

(56) References Cited

U.S. PATENT DOCUMENTS

| | | | | |
|---|---|---|---|---|
| 9,896,269 | B2 * | 2/2018 | Williams | B65G 5/00 |
| 11,401,724 | B2 * | 8/2022 | Morrow | E04H 4/14 |
| 2003/0025381 | A1 * | 2/2003 | Pickren | B65G 5/00<br>405/53 |
| 2003/0216607 | A1 * | 11/2003 | Lindgren | B65F 1/0006<br>588/249.5 |
| 2010/0147516 | A1 * | 6/2010 | Betzer-Zilevitch | B03D 1/02<br>166/272.6 |
| 2012/0119158 | A1 * | 5/2012 | Barchasz | H01M 4/58<br>252/502 |
| 2013/0315794 | A1 * | 11/2013 | Schaffer | C01B 3/58<br>422/187 |
| 2016/0318710 | A1 | 11/2016 | Williams | |
| 2021/0040759 | A1 * | 2/2021 | Morrow | E04H 4/0093 |

* cited by examiner

UNDERGROUND CUBOID SULFUR STORAGE SYSTEMS

FIELD OF THE DISCLOSURE

The present disclosure relates generally to underground cuboid sulfur storage systems and, more particularly, to a system for safe underground storage of sulfur produced as a byproduct of oil and gas operations.

BACKGROUND OF THE DISCLOSURE

Engineered caverns or salt dome formations can be used to store various materials, since engineered caverns and salt domes can have stable geological conditions and large storage capacities. Common substances stored in engineered caverns include natural gas, crude oil, liquefied petroleum gas, compressed air energy storage, hydrogen, carbon dioxide, and sulfur. The engineered caverns are created by solution mining, which is a process that involves injecting fresh water into underground salt deposits and dissolving the salt to create a cavity. Alternatives to engineered caverns can be above ground storage tanks, depleted oil and gas reservoirs, aquifer storage, silos and warehouses, floating storage units, pressurized containers, or pumped hydroelectric storage.

Currently, there is an excess supply of sulfur at low prices that severely impacts the economic viability of producing gas fields containing high $H_2S$. The cost of sulfur handling compared to present buying prices outweighs the economic value and, therefore, storage of sulfur is considered a cheaper alternative as compared to high cost, high emissions trucking or rail carting of molten sulfur. What is needed is a technology for low cost bulk sulfur storage that is sustainable with present environmental policies with the possibility to retrieve all stored sulfur for sale at favorable future market prices or utilize for the manufacture of various secondary products of high commercial value.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, an underground storage unit for storing bulk sulfur may include a base layer further including leachate collection pipes arranged to form a grid of cells and high strength sulfur positioned at each cell. The underground storage unit can further include an intermediate layer including high strength sulfur side walls extending from a perimeter of the base layer and bulk sulfur positioned on top of the base layer. The underground storage unit may further include a top layer positioned at an extent of the side walls and further includes a first sub-layer formed from high strength sulfur, a second sub-layer formed from a rigid moisture resistant material, and a third sub-layer formed from top soil. Additionally, the underground storage unit can include one or more hatches positioned at the top layer that provide access to the bulk sulfur of the intermediate layer.

According to another embodiment consistent with the present disclosure, a system for storing Sulfur can include a project storage site located proximal to an oil and gas field. The project storage site can include two or more underground storage units. Each of the storage units can include a base layer configured to flex and further leachate collection pipes arranged to form a grid of cells, wherein each cell is sealed with high strength sulfur. The storage units can also include an intermediate layer that further includes high strength sulfur side walls extending from and tilted away from a perimeter of the base layer, as well as sulfur cuboids positioned on top of the base layer and aligned with the cells of the base layer. Furthermore, each storage unit can include a top layer spanning an extent of the side walls and further include a first sub-layer formed from high strength sulfur, a second sub-layer formed from a rigid moisture resistant material, and a third sub-layer formed from top soil. Additionally, the storage units can include one or more hatches positioned at the top layer to provide access to the sulfur cuboids of the intermediate layer.

According to another embodiment consistent with the present disclosure, a method for building an underground sulfur storage system proximal to an oil and gas field may include laying high strength sulfur to form a base layer of a first storage unit of the project storage site. The base layer can include a leachate collection system including a plurality of leachate collection pipes arranged to form a grid of cells, each cell being sealed with high strength sulfur. The method may further include laying high strength sulfur to form side walls extending from and tilted away from a perimeter of the base layer of the first storage unit. Further, the method may include storing bulk sulfur on top of the base layer and between the side walls of the first storage unit. Additionally, the method may include laying high strength sulfur spanning extents of the side walls to form a top layer and seal the first storage unit.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
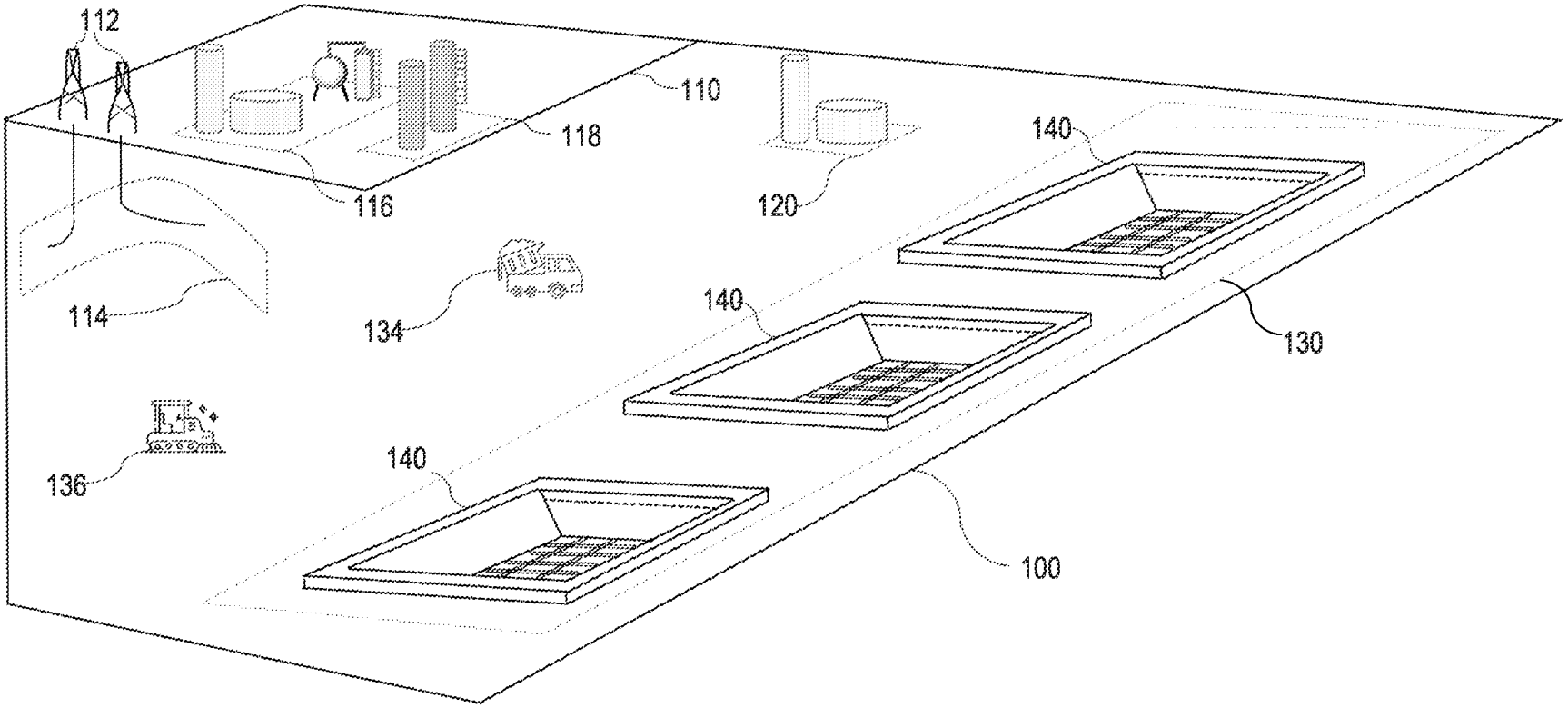
FIG. 1 is a schematic, isometric view of an example system for oilfield cuboid sulfur storage.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to systems and methods for storing sulfur in underground cuboid sulfur storage system.

Conventional underground storage systems are limited to suitable geological formations for underground storage, such as salt domes or depleted oil and gas reservoirs, which are not available in many areas and may necessitate transportation of storage and materials over long distances. Additionally, conventional underground storage systems can be destabilized by geological conditions such as earthquakes or subsidence. Accordingly, conventional underground storage systems can pose environmental risks by leaking hazardous materials into the Earth or surrounding ground water in response to destabilization, accidents, or lack of proper monitoring and maintenance. Further, conventional underground storage systems that are formed from salt domes, rock caverns, or depleted oil and gas reservoirs can have storage capacities limited to the structure used to form the conventional storage system.

The systems described in the present disclosure can be underground or near surface storage systems, such as a landfill type storage system or a closed mine type storage system built in open land and in close proximity to hydrocarbon processing facilities. The systems of the present disclosure can be used to store sulfur produced as byproducts of oil and gas operations, such as operations of the proximal hydrocarbon processing facilities. Moreover, sulfur can be used to build reinforced base layers and side walls of the system described herein, rather than concrete, metal, or clay, which are used in conventional landfill type storage systems.

More particularly, the systems of the present disclosure can be modular cuboid grid storage systems that include units that each have a base layer formed from Sulfur Extended Asphalt (SEA), Pre-cast Sulfur Concrete (PSC), or Sulfur-Asphalt-Sand (SAS). Therefore, the base layer of a unit of the modular cuboid grid storage systems can be high strength layer formed from sulfur. An intermediate, or storage layer of the unit of the modular cuboid grid storage systems, can have bulk sulfur stored as sulfur cuboids between the base layer and a top layer. The top layer of the unit of the modular cuboid grid storage systems include two or three sub-layers, such as a first sub-layer of SAS, SEA, or PSC, a second sub-layer including polyvinyl chloride (PVC), and a third sub-layer including soil that is laid atop the unit. The unit can further be encapsulated at side walls by PSC.

The cuboid grid storage systems described herein can be modular, as the sulfur cuboids of the storage layer can be placed as cuboids or modules across the base layer. The base layer can further include leachate collection pipes designed from spoolable Reinforced Thermoplastic Pipes (RTP) or Flexible Composite Pipes (FCP) that have outer high-density polyethylene (HDCP), chemical compatibility to sulfur, corrosion resistance, and are gas tight. Further, the base layer can be flexible, as well as the unit of modular cuboid grid storage system, such that the unit can manage subsidence or soil movement and tectonic activity. Therefore, a flexible base layer and unit can curtail reinforcement requirements and support natural deep burial occurrences. Accordingly, the leachate system of the base layer can also be flexible, as well as provide a supportive structure for the sulfur cuboids. Moreover, pipes of the leachate system can be aligned as intersecting horizontal and vertical lines to form a grid, the grid having cells organized in rows and columns. Thus, the sulfur cuboids can be placed on cells of the grid formed by the pipes of the leachate system, such that the storage layer can also be flexible.

The top layer of the unit can include a high strength solid sulfur first sub-layer (e.g., SAS, SEA, or PSC) that is laid over the storage layer, or sulfur cuboids. A second-sub-layer that is acid and moisture resistant can be laid over the first sub-layer. A third sub-layer of top soil can be laid over the second sub-layer to form the unit. The top layer, including the sub-layers, can be surrounded by Earth and/or a perimeter wall formed from PSC. At the perimeter wall, a remote sulfur detection system can provide gas and moisture sensing wells or probes beneath the ground at or proximal to the storage unit, as well as transmit measurements and sensed sulfur of the ground to a remote computer system. Furthermore, one or more recovery hatches can be placed in the top layer, such as between a second sub-layer (e.g., PVC) and the third sub-layer (e.g., top soil). The recovery hatches can be geo tagged for efficient recovery of the sulfur of the storage unit and provide a hoist system access to the sulfur cuboids of the second layer of the unit.

FIG. 1 is a schematic, isometric view of an example system for oilfield cuboid sulfur storage 100 that includes an oil and gas field 110. The oil and gas field 110 can include wells 112 that produce sour hydrocarbon 114, which is oil or natural gas that has a high concentration of hydrogen sulfide ($H_2S$). Because $H_2S$ is a toxic and corrosive gas, the oil and gas field 110 can include further equipment for processing the sour hydrocarbon 114. For example, the wells 112 can include corrosion resistant materials for well casing, tubing, and other downhole components such as sulfur sensors. The oil and gas field 110 can further include an acid gas recovery system (AGR) system 116, which receives a raw gas stream from the wells 112, such as a sour stream of hydrocarbon gas or acid gas produced from the sour hydrocarbon 114. The AGR system 116 can separate $H_2S$, as well as carbon dioxide ($CO_2$), from the raw gas stream to produce an $H_2S$ rich stream using physical, chemical or a combination of physical and chemical separation techniques. Accordingly, the AGR system 116 can provide the $H_2S$ rich stream to a sulfur recovery unit (SRU) 118 for sulfur separation. The SRU 118 can perform a Claus process, or another similar desulfurizing process to convert the $H_2S$ to sulfur. For example, a Claus process can convert $H_2S$ to sulfur through a two step thermal and catalytic that produces commercial sulfur. Additionally, the Claus process can produce a tail gas that contains residual sulfur. Accordingly, the SRU 118 can include a tail gas treatment unit to remove remaining sulfur from the tail gas and produce further elemental sulfur and/or sulfuric acid. Thus, the oil and gas field 110 can be employed to gather and remove Sulfur from sour hydrocarbon produced from wells 112.

The system for oilfield cuboid sulfur storage 100 can further include a concrete and asphalt facility 120 located proximal to the oil and gas field 110. Accordingly, the sulfur produced by the oil and gas field 110 can be provided to the concrete and asphalt facility 120. The concrete and asphalt facility 120 can convert elemental sulfur produced by the oil and gas field 110 to Pre-Cast Sulfur Concrete (PSC), Sulfur Extended Asphalt (SEA), Sulfur-Asphalt-Sand (SAS), and/ or bulk sulfur blocks. For example, elemental Sulfur can be provided to the concrete and asphalt facility 120 as bulk sulfur or pellets. In some examples, elemental sulfur can be provided to the concrete and asphalt facility 120 as molten sulfur. In other examples, the concrete and asphalt facility 120 can melt elemental sulfur into molten sulfur. Accordingly, sulfur can be used as a liquid binder that can be mixed with aggregate (e.g., sand, gravel, crushed stone, etc.) and filler (e.g., fly ash) to form a sulfur concrete mixture. The sulfur concrete mixture can be poured into a fiberglass mold for a beam, slab, or panel, such that the Sulfur concrete mixture can cool and crystallize in the mold to form a PCS component available for transportation.

Similarly, SEA can be formed at the concrete and asphalt facility 120 by mixing sulfur with a binder. In some examples, SEA can be formed by mixing sulfur with bitumen (e.g., asphalt or tar) to create a sulfur-bitumen binder. The sulfur-bitumen binder can be combined with an aggregate to form SEA, which can be applied to a prepared surface via paving machine prior to cooling of the SEA. To form SAS, the concrete and asphalt facility can again employ molten Sulfur. For example, the concrete and asphalt facility 120 can mix molten sulfur with sand and other additives to form SAS, which can be applied to a prepared surface similar to SEA. Additionally, the concrete and asphalt facility 120 can be employed to produce bulk sulfur blocks or cuboids. In some examples, the bulk sulfur can be provided to the concrete and asphalt facility 120 as pellets. In other examples, the concrete and asphalt facility 120 can prill, pelletize, or granulate sulfur in preparation for compaction of the sulfur into a cuboid. In further examples, the concrete and asphalt facility 120 can melt elemental sulfur into a molten sulfur and form the molten sulfur into cuboids via extrusion, granulation, or casting in a mold similar to PCS. Accordingly, the sulfur cuboids, SAS, SEA, and PSC can be transported to a project storage site 130. Moreover, pelletized or granulated sulfur can be transported and compacted into sulfur cuboids at the project storage site 130.

The system for oilfield cuboid sulfur storage 100 can include a project storage site 130 proximal to the oil and gas field 110. The sulfur cuboids and/or sulfur pellets can be moved to the project storage site 130 via bulk sulfur dump trucks 134. Additionally, the SAS, SEA, and PSC can be transported to the project storage site 130 via sulfur moving and compaction vehicles 136. The sulfur moving and compaction vehicles 136 can be utility vehicles that are capable of laying asphalt (e.g., SEA and SAS) and concrete (e.g., PSC), as well as compacting sulfur pellets into sulfur cuboids. The project storage site 130 can further include one or more storage units 140. The storage units 140 can be constructed from the SEA, SAS, PSC produced by the concrete and asphalt facility 120 and transported by the sulfur moving and compaction vehicles 136. The storage units 140 can further be constructed from sulfur cuboids that are transported to the project storage site 130 via the bulk sulfur dump trucks 134. In some examples, the bulk sulfur dump trucks 134 can transfer sulfur in different states (e.g., molten, bulk, or solid sulfur) to and from the concrete and asphalt facility 120 based on available space of the storage units 140. Accordingly, the sulfur cuboids can be formed at the project storage site 130 by the moving and compaction vehicles 136.

Because the project storage site 130 is positioned proximal to the oil and gas field 110 and the concrete and asphalt facility 120, the system for oilfield cuboid Sulfur storage 100 can reduce spills and emissions associated with Sulfur trucking operations. Additionally, the project storage site 130 provides a safe environmental option for long term storage of Sulfur produced by the oil and gas field 110.

Figure 2:
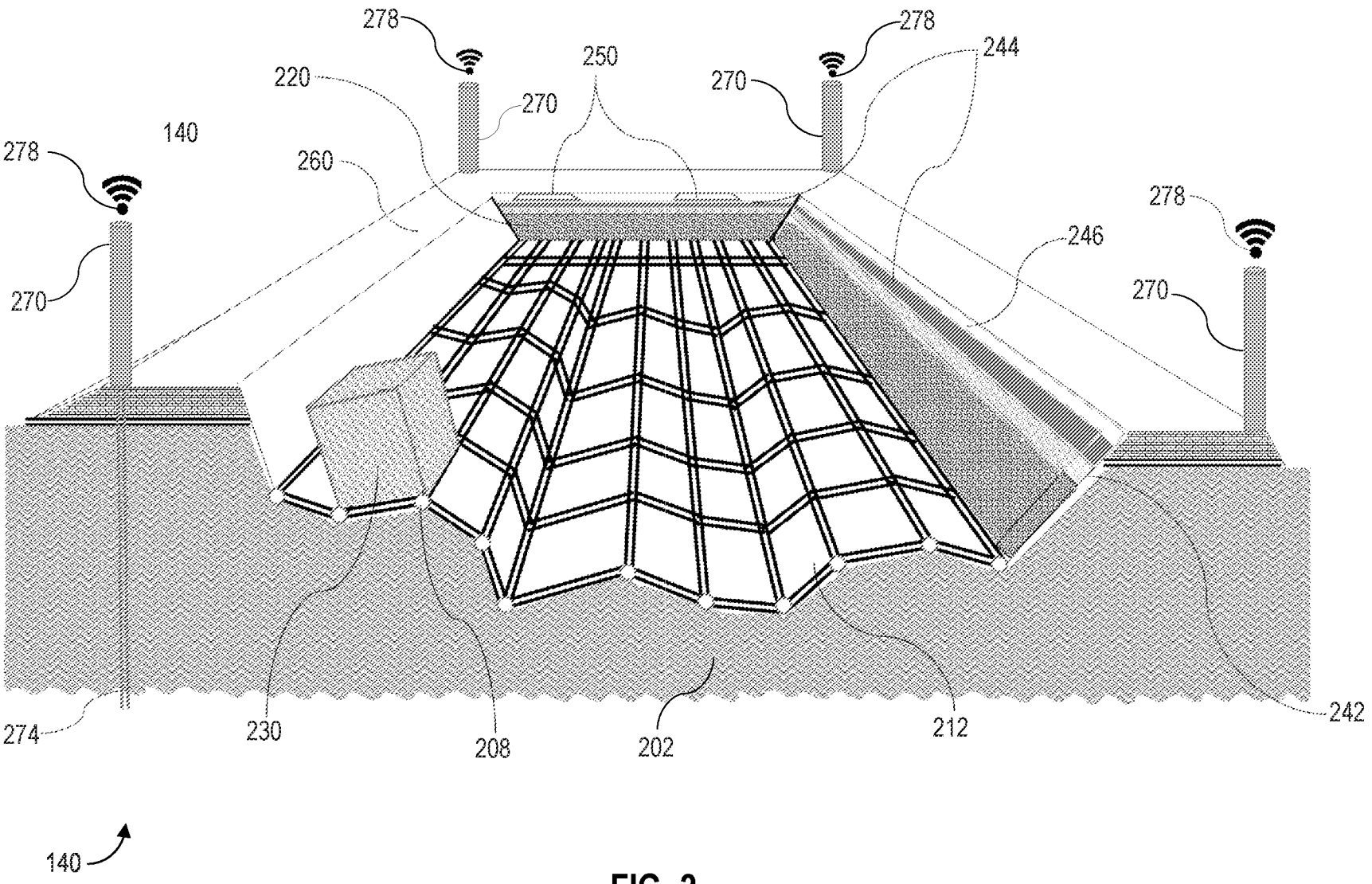
FIG. 2 is a schematic, isometric diagram of an example storage unit.

FIG. 2 is an enlarged, isometric diagram of an example storage unit 140, according to one or more embodiments. In an embodiment, the storage unit 140 has a base layer disposed beneath the surface of ground 202 (e.g., Earth). The base layer can include a leachate system that incorporates vertically and horizontally arranged leachate collection pipes 208 designed from spoolable Reinforced Thermoplastic Pipes (RTP) or Flexible Composite Pipes (FCP). The leachate collection pipes 208 can collect leachate to remove excess moisture from the storage unit 140. Moreover, the leachate system can be coupled to a mobile moisture testing station or remote computer system to measure water content of the storage unit 140. Furthermore, the leachate collection pipes 208 can be arranged vertically and horizontally across the base layer to form rows and columns of cells 212 between the leachate collection pipes 208. That is, the leachate collection pipes 208 can form a grid of cells 212 across the base layer.

The cells 212 of the base layer can be sealed with moisture barriers, such as SEA, to prevent exposure to the environment, weather elements, sulfur loss, and sulfur acid run to the surrounding environment. Therefore, the leachate collection pipes 208 and cells 212 can prevent leachate and stored materials, such as Sulfur, from escaping in the ground 202 below and surrounding the storage unit 140. Additionally, cells 212 formed from SEA can protect stored materials from conditions of the surrounding environment, such as moisture and movement of the ground 202 surrounding the storage unit 140. In an embodiment, the SEA can be produced at the asphalt and concrete and asphalt facility 120 of FIG. 1 and applied to the cells 212 of the base layer by, for example, the sulfur moving and compaction vehicles 136 of FIG. 1. In some embodiments, the SEA can be laid to form the layer and the leachate collection pipes can be laid over the SEA. In other embodiments, the cells 212 of the base layer can be sealed with PSC or SAS.

The base layer of the storage unit 140 can be substantially rectangular, such that the base layer has a length and width. In an example embodiment, base layer of the storage unit can have a length of 20 meters and a width of 50 meters. Moreover, the storage unit 140 can have an intermediate layer that is formed from side walls 220. The side walls 220 can be disposed along a perimeter of the base layer, each side wall 220 having a height, as well as a first and second end. The first and second ends of each side wall 220 can be adjacent to an end of a neighboring side wall 220, thereby forming an enclosure around the storage unit 140. In an example embodiment, each side wall 220 can also have a height of 20 meters that extends from the base layer, such that the storage unit 140 has a depth of approximately 20 meters. Furthermore, each side wall 220 can extend at an angle away from the base layer, such that each side wall 220 has a height that is tilted away from the base layer. The tilted orientation of the side walls 220 can protect the storage unit 140 from subsidence or movement of the surrounding ground 202 beneath and/or around the storage unit 140. Furthermore, the side walls 220 can be formed from a high strength sulfur, such as PSC.

The intermediate layer of the storage unit 140 can further include sulfur cuboids 230 placed at, or on top of cells 212 of the storage unit 140. Because the cells 212 are formed or defined by horizontal and vertical leachate collection pipes 208, the cells 212 can be substantially rectangular. Accordingly, the sulfur cuboids 230 can have a cuboid shape that is substantially rectangular and complementary to cells 212 of the storage unit 140. Therefore, a given sulfur cuboid 230 of the intermediate layer can have a length and width that aligns with a cell 212 of the base layer. Moreover, the given sulfur cuboid 230 can have a height that is equal to or less than the height of the side walls 220 of the storage unit 140. In some examples, multiple sulfur cuboids 230 can be placed within a single cell 212 of the storage unit 140. In other examples, a sulfur cuboid 230 have a length and/or width that extends past a length and width of a corresponding cell 212. Moreover, bulk sulfur (e.g., pellets) can be stored in the intermediate layer of the storage unit 140.

The intermediate layer can be formed by the side walls 220 and contain a plurality of Sulfur cuboids 230 at each of, or a plurality of the cells 212 of the storage unit 140. In other words, the intermediate layer can be a compartment that stores the sulfur cuboids 230 as storage in the storage unit 140. The storage unit can further include a top layer formed from a Sulfur sub-layer 242, a rigid sub-layer 244, and a soil sub-layer 246. The sulfur sub-layer 242 can be a continuous and substantially horizontal surface that extends from an extent of each side wall 220 to span the length and the width of the storage unit 140. The sulfur sub-layer 242 can be integrated with or securely attached to the extents of the side walls 220 to form a structurally stable upper boundary of the storage unit 140. In an example embodiment, the sulfur sub-layer can be formed from SEA. In another example, the sulfur sub-layer 242 can be formed from another high strength sulfur, such as PSC and similar to the side walls 220.

The top layer can further include a rigid sub-layer 244 that is laid over the sulfur sub-layer 242. The rigid sub-layer 244 can cover the sulfur sub-layer 242, such that the rigid sub-layer 244 has a surface area that aligns with the surface area of the sulfur sub-layer 242. The rigid sub-layer 244 can be an acid and moisture resistant rigid polyvinyl chloride (e.g., PVC) that can further be rolled and adhered to a top surface of the sulfur sub-layer 242. Therefore, the rigid sub-layer 244 can protect the storage unit 140 from rain, moisture, and other environmental conditions. Thus, the storage unit 140 can be sealed by the rigid sub-layer 244 before applying a soil sub-layer 246. The soil sub-layer 246 can be top soil, sand, or material similar to the ground 202 that is laid over the rigid sub-layer 244.

Furthermore, the top layer can include one or more recovery hatches 250 placed between the rigid sub-layer 244 and the soil sub-layer 246. Particularly, the hatches 250 can be provided at various positions across the top layer to provide access to the intermediate layer to retrieve sulfur cuboids 230. Therefore, the hatches 250 can be placed at the top side or surface of the rigid sub-layer 244 to provide an access point through the rigid sub-layer 244 and the sulfur sub-layer 242. The hatches 250 can be formed from non-metallic high strength RTP/FCP to eliminate risk of corrosion and to protect the sulfur cuboids 230 and the storage unit 140. In the illustrated embodiment, two recovery hatches 250 are shown, but more or less than two can be employed, without departing from the scope of the disclosure. Because the hatches 250 and the leachate collection pipes are formed from non-metallic material (e.g., RTP/FCP), the storage unit 140 can be resistant to corrosion.

Moreover, the hatches 250 can be covered by the soil sub-layer 246, or the hatches 250 can become concealed by wind-driven soil or ground 202 accumulation. Thus, the hatches 250 can be tagged physically and geographically with sensors. In some examples, the sensors are non-electronic sensors that are detectable by Ground Penetrating Radar (GPR) or similar sensing technology. Accordingly, the hatches 250 can be located and employed for future recovery and tests of Sulfur cuboids 230 stored in the intermediate layer.

The storage unit 140 can further include a perimeter wall 260. The perimeter wall 260 can encircle the top layer and an upper portion of the side walls 220 of the intermediate layer to form a boundary that further protects the storage unit 140 from the environment, such as the ground 202. The perimeter wall 260 may further be formed from PSC, such as the high strength sulfur that can be employed to form the side walls 220 of the intermediate layer. Accordingly, the perimeter wall 260 can provide further support and protection to the storage unit 140.

A remote sulfur detection system can be incorporated with the storage unit 140. In an example embodiment, the remote Sulfur detection system includes one or more detection sensors 270 (four shown) that are placed at various positions along the perimeter wall 260. The detection sensors 270 may be integrated with or affixed to a corresponding sensing well 274 that extends beneath the perimeter wall 260 and beyond the depth of the storage unit 140. The detection sensors 270 can sense moisture and/or gas, such that the detection sensors can detect leakage of sulfur into the ground 202 beneath or surrounding the storage unit 140, as well as excess moisture. Moreover, each of the detection sensors 270 can include a wireless transceiver 278 to communicate over a wireless network, such that the detection sensors can communicate measurement data with a remote computer system via a corresponding wireless transceiver 278.

In some examples, the detection sensors 270 can be positioned at surface boundaries of the sulfur cuboids 230 to detect migrating sulfur gas. Therefore, the detection sensors 270 positioned at or near the sulfur cuboids 230 can detect early leakage of sulfur relative to detection sensors 270 positioned at the perimeter wall and sensing wells 274. In other examples, the remote Sulfur detection system can include the mobile moisture testing station coupled to the leachate collection pipes 208. Therefore, detection sensors 270 can further measure sulfur if present in liquids of the leachate system. Additionally, the detection sensors 270 coupled to the leachate collection pipes 208 and/or the sulfur cuboids 230 can measure moisture within the storage unit 140 to ensure that the sulfur cuboids 230 are maintained dry enough to meet long term preservation requirements.

Figure 3:
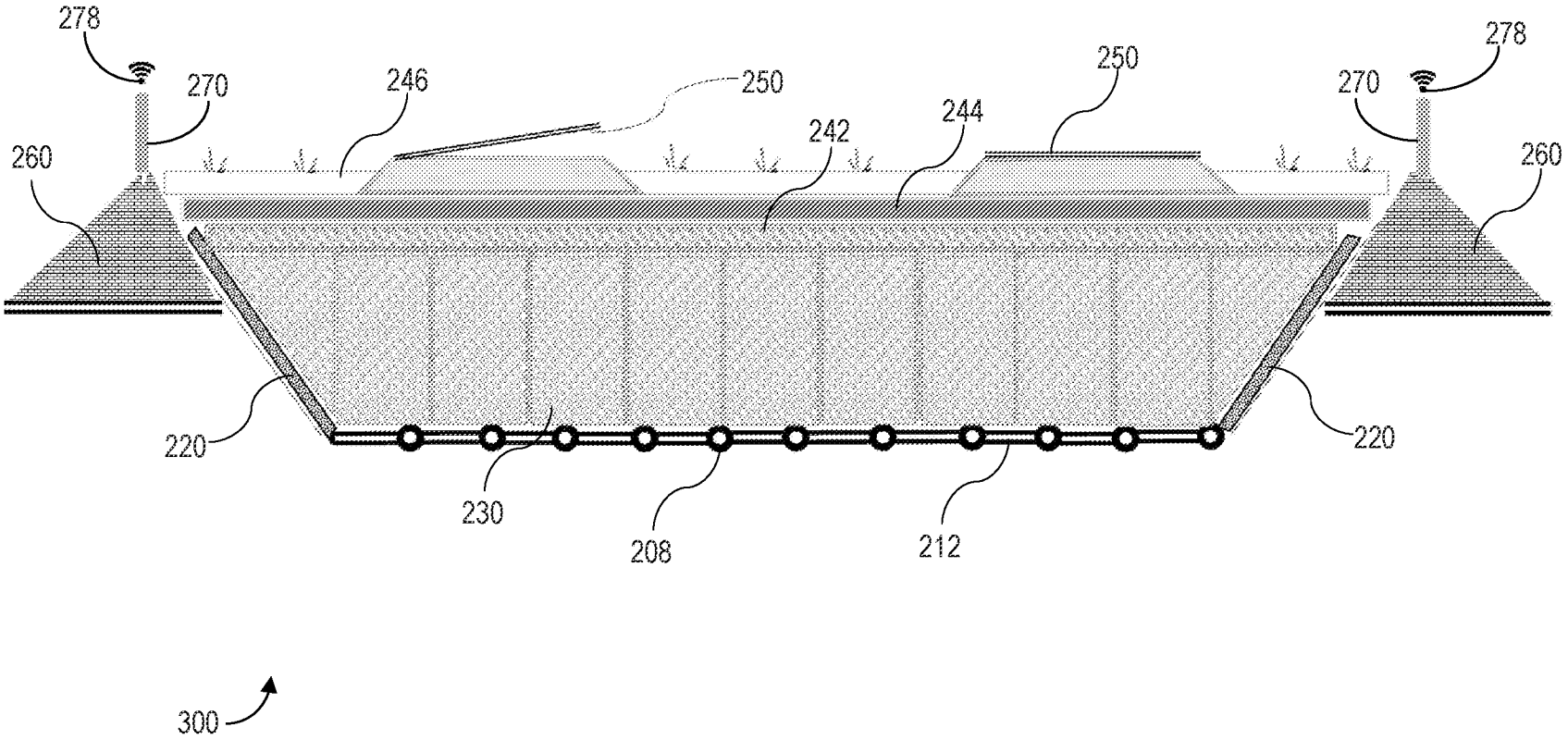
FIG. 3 is an isometric, side view of the example storage unit in a normal mode.

FIG. 3 is an isometric, side view of the storage unit 140 operating in a normal mode 300. Again, the storage unit 140 can have a base layer that includes leachate collection pipes 208 that define a plurality of cells 212 formed from SEA. While operating in normal mode 300, each of the cells 212 can have a length and width positioned on the same two-dimensional plane defined by the base layer. Moreover, each of the leachate collection pipes 208 can have a length or central axis that extends along the two-dimensional plane defined by the base layer. Accordingly, the base layer, composed of the leachate collection pipes 208 and cells 212, can be a flat surface at the bottom of the storage unit 140.

The storage unit 140 can be formed in normal mode 300, such that the leachate collection pipes 208 are laid flat, forming a flat grid of cells 212. Therefore, the base layer can readily receive sulfur cuboids 230, which can be uniformly distributed across the base layer. Under ideal environmental conditions, the base layer will remain flat, such that the storage unit 140 will perpetually operate in normal mode 300.

Figure 4:
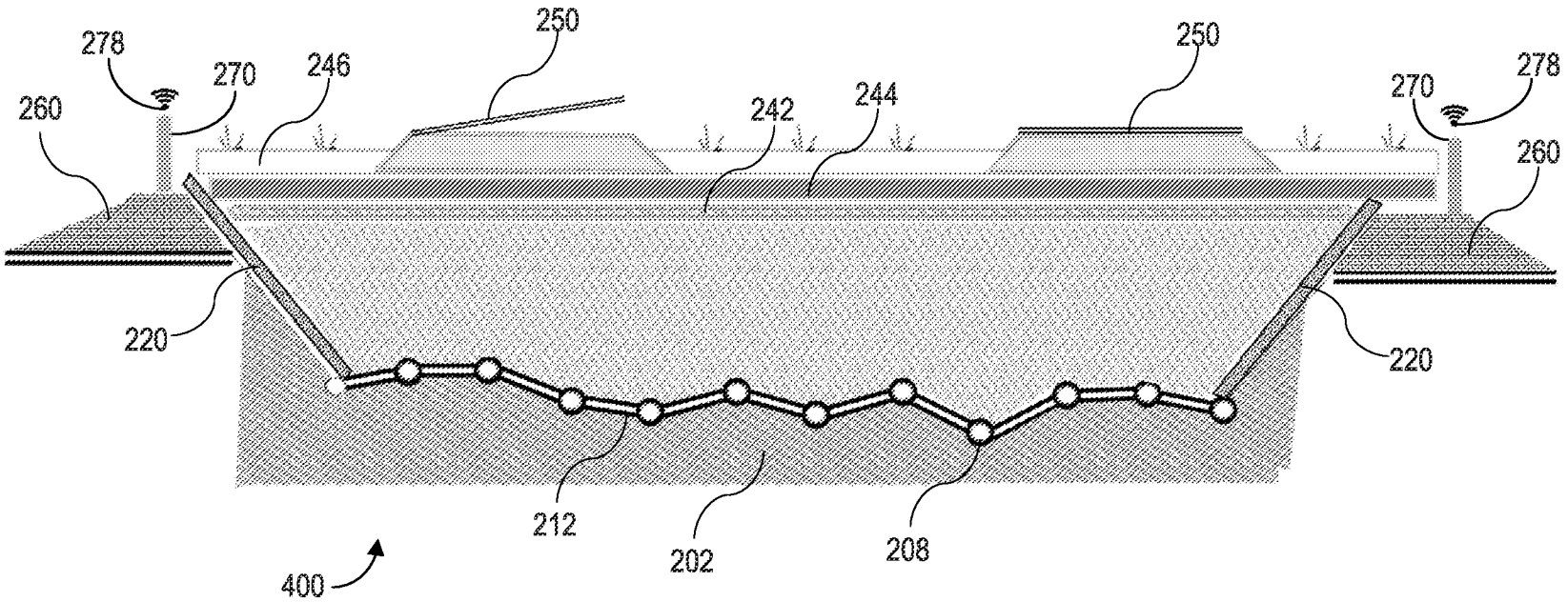
FIG. 4 is an isometric, side view of the example storage unit in a flexible mode.

FIG. 4 is an isometric, side view of the storage unit 140 operating in a flexible mode 400. In response to subsidence below and/or around the storage unit 140, the base layer of the storage unit 140 can flex to adapt to changes in the ground 202 surrounding the storage unit 140. That is, the grid of cells 212 defined by the leachate collection pipes 208 can be free to move and adapt to subsidence in the ground 202. Rather than cracking or collapsing, a given cell 212 can change position from the initial flat plane of the normal mode 300 (FIG. 3) to a flexed (e.g. offset) position in the flexible mode 400. Although the base layer can flex, the cells 212 can further support sulfur cuboids 230 or other materials stored in the intermediate layer while in the flexible mode 400. Moreover, the base layer can adapt to subsidence in the surrounding ground 202 and prevent sulfur from leaking into the ground 202, as well as prevent moisture from entering the storage unit 140 while in the flexible mode 400. Additionally, the capability of the cells 212 and leachate collection pipes 208 of the base layer to operate in a normal mode 300 and a flexible mode 400 obviate the need for additional reinforcement requirements.

In another example, the cells 212 can be flexibly coupled together to allow cells 212 to move and adapt to subsidence in the ground 202. Alternatively, a pair of adjacent cells 212 can be flexibly coupled to a leachate collection pipe 208 positioned between the pair of adjacent cells 212. In another embodiment, cells 212 can be arranged to allow for flexibility among a subset of the cells 212. For example, each cell 212 can be flexibly attached to adjacent cells 212 of the same row of cells 212 and fixedly attached to adjacent cells 212 of the same column of cells 212. Therefore, cells 212 of a given column can remain positioned on a common two-dimensional geometrical plane while in flexible mode 400. Because the cells 212 of the given column can each be flexibly attached to adjacent columns of cells, the common two-dimensional plane of the given column of cells 212 can flex or tilt relative to adjacent columns of cells 212. Alternatively, each cell 212 can be fixedly attached to an adjacent cell 212 of the same row and flexibly attached to adjacent cells of the same column. Regardless of the coupling arrangement between cells 212, each cell 212 is defined by the leachate collection system, such that each edge of each cell 212 corresponds to a leachate collection pipe 208.

Figure 5:
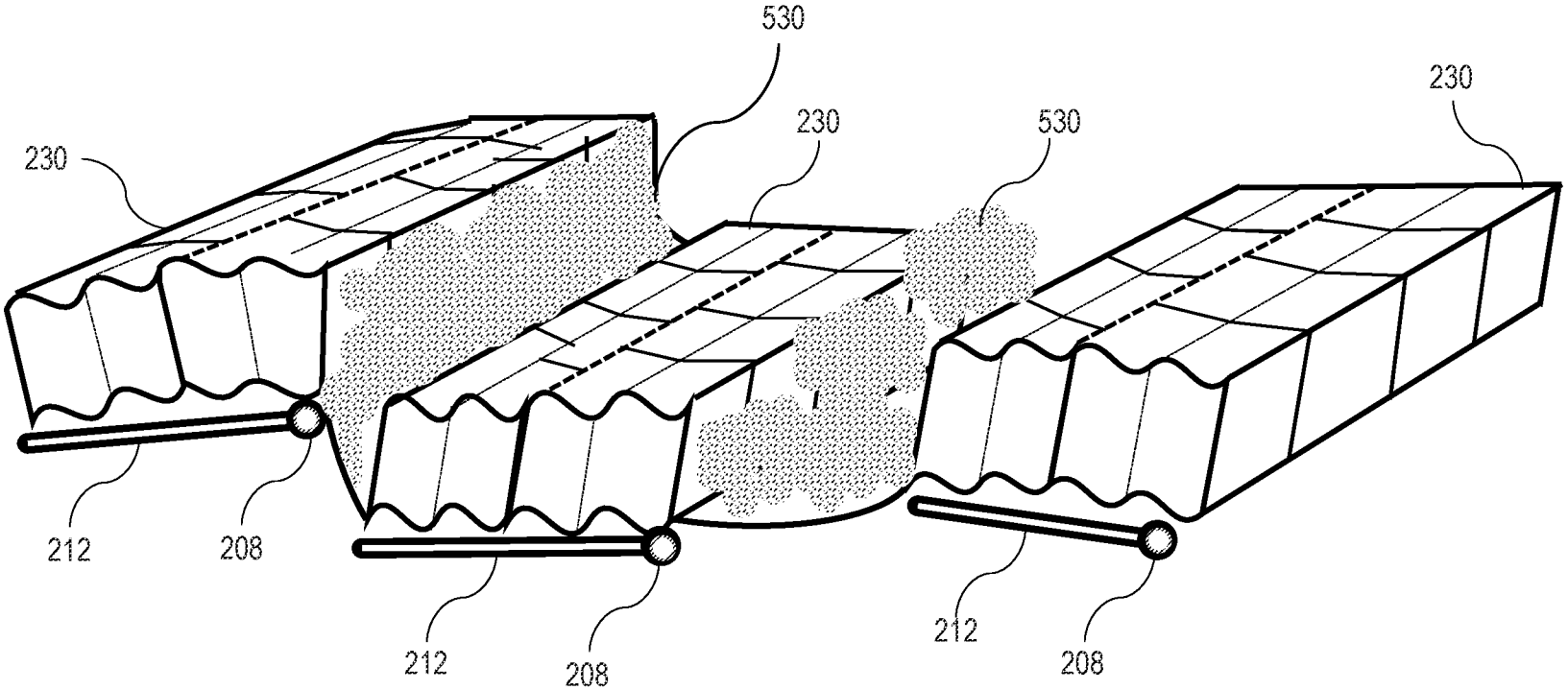
FIG. 5 is enlarged, isometric view of a storage unit.

FIG. 5 is an enlarged, isometric view of a base layer and Sulfur stored in a storage unit (e.g., storage unit 140 of FIGS. 1-4) operating in the flexible mode 400. The base layer can include leachate collection pipes 208 and cells 212 (FIGS. 2-4). Additionally, the sulfur stored on top of the base layer can include Sulfur cuboids 230 (FIG. 2), as well as bulk sulfur 530. The bulk sulfur 530 can be the same as or similar to sulfur pellets that are compacted to form the sulfur cuboids 230. In some examples, bulk sulfur 530 can be placed over cells 212 with, or instead of sulfur cuboids 230. In further examples, friction or movement of the cells 212 can cause a given sulfur cuboid 230 to shed or lose bulk sulfur 530 that was employed to form the given sulfur cuboid 230. Moreover, the rectangular shape of sulfur cuboids 230 can be elastic to compensate for flexion and friction with neighboring sulfur cuboids 230, but maintain a substantially rectangular shape. Regardless of subsidence, as well as movement of sulfur cuboids 230 and bulk sulfur 530, the base layer can flex to the flexible mode 400 and maintain the bulk sulfur 530 and sulfur cuboids 230 of the corresponding storage unit in response to subsidence.

In some examples, the base layer can be flexible enough to allow for separation of the cells 212 both horizontally and vertically. Accordingly, the base layer can be flexible enough to allow for individual cells 212 to move with or away from laterally adjacent cells 212 to compensate for subsidence below or around the corresponding storage unit. In such an example, a flexible coupling between cells 212 can maintain the base layer of the corresponding storage unit to retain bulk Sulfur 530 and Sulfur cuboids 230. Therefore, the base layer is flexible enough to handle extreme and/or prolonged subsidence beneath and around the storage unit.

Figure 6:
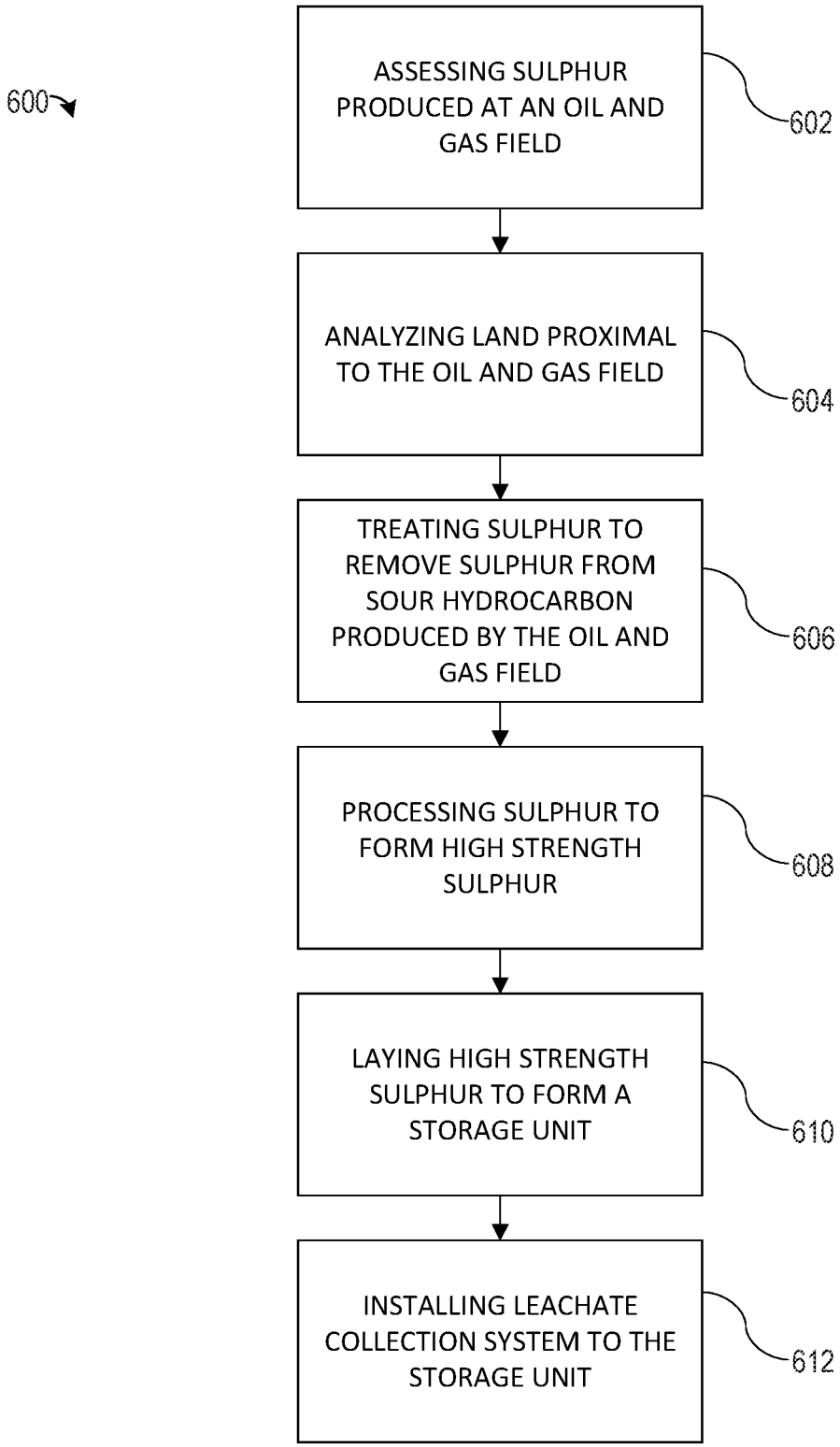
FIG. 6 is a flowchart of an example method of building a project storage site.

FIG. 6 is a schematic flow chart of an example method 600 of building a project storage site, according to one or more embodiments. The method 600 may include assessing sulfur produced from oil and gas field to determine a volumetric estimation produced, a material balance assessment, and a cost of the sulfur produced by the oil and gas field, as at 602. The method 600 can further include analyzing a project storage site, or land proximal to the oil and gas field to determine a location and size of the project storage site, as at 604. The analysis of the land can include analyzing temperature and soil analysis, land surveys, and compaction testing. In an example, assessments made at 602, such as the volumetric estimation of the sulfur, can be employed in the analysis of 604, such as in determining an area of land to analyze. In response to analyzing a project storage site at 604, the method 600 can include treating sulfur, as at 606. Treating sulfur can include developing a sulfur recovery unit connected to an acid gas recovery system to separate sulfur from raw gas, such as sour hydrocarbon. In response to treating sulfur, as at 606, the method 600 can include processing sulfur, as at 608. Processing sulfur can include forming sulfur cuboids, SEA, PSC, and SAS from bulk Sulfur produced from treating the sulfur.

In response to forming sulfur cuboids, SEA, PSC, and SAS from bulk sulfur, the method 600 can include laying sulfur, as at 610. Laying sulfur can further include laying cured high strength sulfur, such as SEA, PSC, or SEA to form a base layer of a storage unit. Furthermore, laying sulfur can include laying high strength sulfur, such as PSC, to form side walls of the storage unit. Moreover, the method 600 can include installing a leachate collection system, as at 612. Installing the leachate collection system includes installing spoolable RTP/FCP leachate collection pipes across the base layer and connecting the leachate collection system to a moisture sensing system. Storage units can be continuously formed by repeating steps 610 and 612 of the method 600 until the project storage site is saturated according to the analysis performed at 604.

Figure 7:
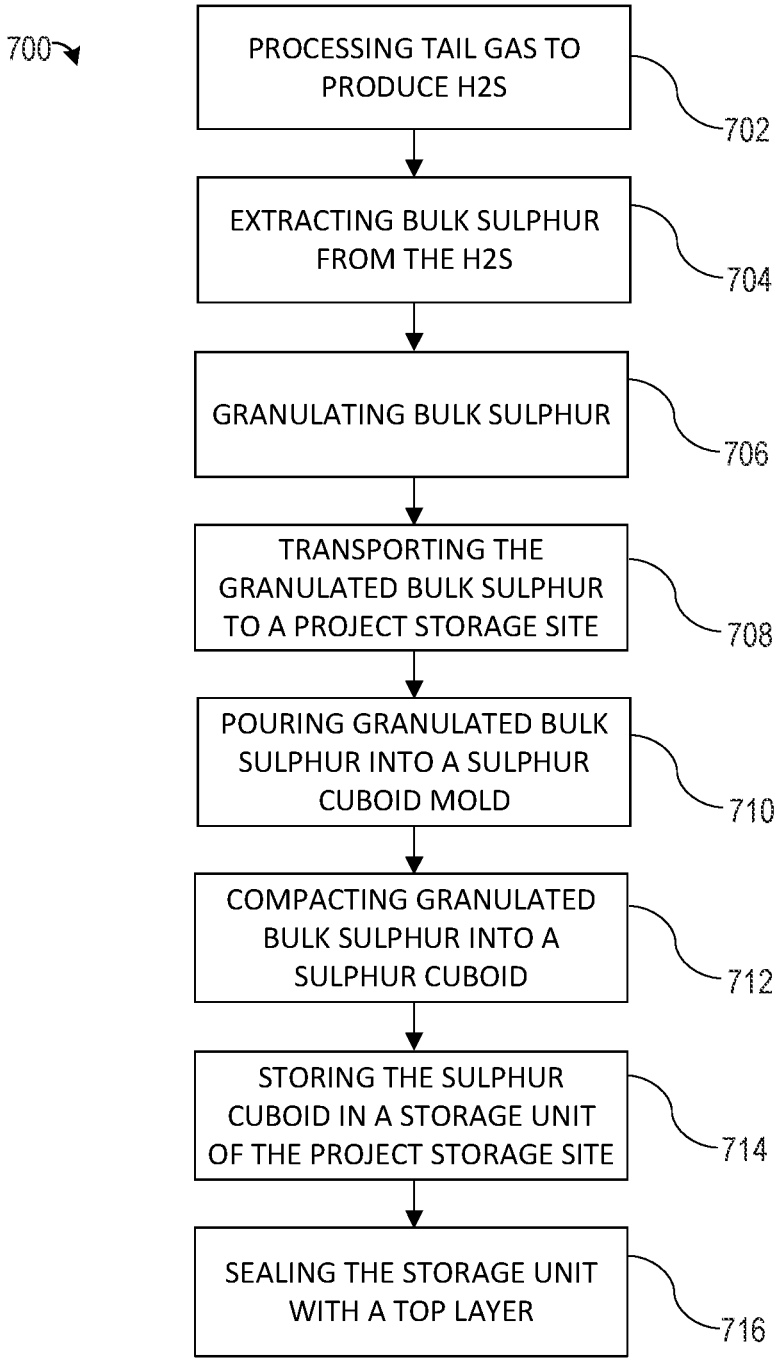
FIG. 7 is a flowchart of an example method of storing Sulfur in storage units of a projects storage site.

FIG. 7 is a schematic flow chart of an example method 700 of utilizing a storage unit of a project storage site, according to one or more embodiments. The method 700 can include processing tail gas or acid gas to obtain $H_2S$ for bulk sulfur production, as at 702. Processing tail gas can include, for example, performing a Claus process using commercially available equipment on the tail gas. Bulk sulfur can be extracted from the $H_2S$, as at 704. Accordingly, the bulk sulfur can be granulated, prilled, or pelletized, as at 706. In response, the bulk sulfur can be transported to storage units of a project storage site as granulated bulk sulfur, as at 708. In some examples, a sulfur dump truck can transport the bulk sulfur. In other examples, a moving and compaction utility vehicle can transport the bulk sulfur. The bulk sulfur can be poured into a mold or shaped as a sulfur cuboid, as at 710. At 712, the bulk sulfur contained in the mold can be compacted into a sulfur cuboid. In some examples, a moving and compaction truck can compact the bulk sulfur of the mold. The method 700 can further including storing the sulfur cuboid in the storage unit of the project storage site, as at 714.

Steps 710, 712, and 714 can be repeated until the storage unit is saturated (filled) with sulfur cuboids. In some examples, granulated bulk sulfur can be added to the storage unit at 714. Once the storage unit is full of sulfur cuboids, a top layer can be installed at the top of the storage unit to seal the storage unit, as at 716. For example the top layer can include sub-layers, such that high strength sulfur is first laid on top of the storage unit. A rigid sub-layer made from PVC can be laid on top of the high strength Sulfur sub-layer. Additionally, a soil sub-layer can be laid on top of the PVC to complete the storage unit. Accordingly, steps 708, 710, 712, 714, and 716 can be repeated for additional storage units until each storage of the project storage unit is filled and scaled.

Embodiments disclosed herein include:

A. An underground storage unit for storing bulk sulfur includes a base layer comprising leachate collection pipes arranged to form a grid of cells, and high strength sulfur positioned at each cell, an intermediate layer comprising high strength sulfur side walls extending from a perimeter of the base layer, and bulk sulfur positioned on top of the base layer, a top layer positioned at an extent of the side walls and comprising a first sub-layer formed from high strength sulfur, a second sub-layer formed from a rigid moisture resistant material, and a third sub-layer formed from top soil, and one or more hatches positioned at the top layer that provide access to the bulk sulfur of the intermediate layer.

B. A system for storing sulfur includes a project storage site located proximal to an oil and gas field comprising two or more underground storage units, each underground storage unit comprising a base layer configured to flex and comprising leachate collection pipes arranged to form a grid of cells, wherein each cell is sealed with high strength sulfur, an intermediate layer comprising high strength sulfur side walls extending from and tilted away from a perimeter of the base layer, and sulfur cuboids positioned on top of the base layer and aligned with the cells of the base layer, a top layer spanning an extent of the side walls and comprising a first sub-layer formed from high strength sulfur, a second sub-layer formed from a rigid moisture resistant material, and a third sub-layer formed from top soil, and one or more hatches positioned at the top layer to provide access to the sulfur cuboids of the intermediate layer.

C. A method for building an underground sulfur storage system proximal to an oil and gas field includes laying high strength sulfur to form a base layer of a first storage unit of the project storage site, the base layer comprising a leachate collection system including a plurality of leachate collection pipes arranged to form a grid of cells, each cell being sealed with high strength sulfur, laying high strength sulfur to form side walls extending from and tilted away from a perimeter of the base layer of the first storage unit, storing bulk sulfur on top of the base layer and between the side walls of the first storage unit, and laying high strength sulfur spanning extents of the side walls to form a top layer and seal the first storage unit.

Each of embodiments A, B, and C may have one or more of the following additional elements in any combination: Element 1: wherein the side walls are angled away from the base layer. Element 2: further comprising a perimeter wall formed from high strength sulfur that encircles the top layer. Element 3: further comprising a sulfur detection system that includes a plurality of detection sensors configured to sense sulfur and moisture in sensing wells extending beneath the perimeter wall. Element 4: wherein the bulk sulfur comprises a plurality of sulfur cuboids aligned with the grid of cells, and the plurality of detection sensors are positioned at or near the sulfur cuboids within the intermediate layer. Element 5: wherein the high strength sulfur side walls, the cells of the grid, and the first sub-layer are each formed from Pre-case Sulfur Concrete (PSC), Sulfur Extended Asphalt (SEA), or Sulfur-Asphalt-Sand (SAS). Element 6: wherein the second sub-layer and the one or more hatches are formed from spoolable Reinforced Thermoplastic Pipes (RTP) or Flexible Composite Pipes (FCP). Element 7: wherein the cells of the grid of the base layer are flexibly coupled to adjacent cells such that the base layer flexes in response to subsidence below or surrounding the underground storage unit.

Element 8: wherein the cells are sealed with Sulfur Extended Asphalt (SEA) formed at a concrete and asphalt facility located at the project storage site. Element 9: wherein the high strength sulfur side walls and first sub-layer are formed from Pre-cast Sulfur Concrete (PSC) at the concrete and asphalt facility and the concrete and asphalt facility forms PSC and SEA from bulk Sulfur produced from sour hydrocarbon at the oil and gas field. Element 10: wherein the sulfur cuboids are formed at the project storage by compacting bulk sulfur produced from sour hydrocarbon at the oil and gas field. Element 11: wherein the second sub-layer and the hatches are formed from spoolable Reinforced Thermoplastic Pipes (RTP) or Flexible Composite Pipes (FCP). Element 12: further comprising a perimeter wall formed from PSC that encircles the top layer and a portion of the side walls. Element 13: further comprising a sulfur detection system including a plurality of detection sensors configured to sense sulfur and moisture in sensing wells beneath the perimeter wall and between sulfur cuboids of the intermediate layer. Element 14: wherein the second sub-layer is formed from polyvinyl chloride (PVC).

Element 15: the method further comprising compacting bulk sulfur into sulfur cuboids at the project storage site, storing the sulfur cuboids in the intermediate layer to align with the grid of cells of the base layer, laying polyvinyl chloride (PVC) on top of the high strength sulfur of the top layer to resist acid and moisture, and accessing the sulfur cuboids on top of the base layer through a hatch positioned at the top layer. Element 16: further comprising flexing the base layer between a normal mode and a flexible mode in response to subsidence below or near the storage unit. Element 17: wherein the project storage site further includes a second storage unit, the method further comprising assessing sulfur produced at the oil and gas field to determine a volumetric estimation of the sulfur of the first and second storage units, analyzing land proximal to the oil and gas field to determine a location and size of a project storage site based on the volumetric estimation, treating, via sulfur recovery unit, oil and gas produced by the oil and gas field to extract the sulfur as bulk sulfur, processing, via a concrete and asphalt facility, bulk sulfur to form high strength sulfur, and transporting high strength sulfur and bulk sulfur to the project storage site.

By way of non-limiting example, exemplary combinations applicable to A, B, and C include: Element 1 with Element 2; Element 2 with Element 3; Element 3 with Element 4; Element 8 with Element 9; Element 12 with Element 13; and Element 16 with Element 17;

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. An underground storage unit for storing bulk sulfur comprising:

a base layer having a length and a width defining a substantially rectangular shape configured to flex, the base layer comprising leachate collection pipes arranged to form a grid of cells, and high strength sulfur positioned at each cell;

an intermediate layer having a substantially cuboid shape aligned with the cells of the base layer, the intermediate layer comprising high strength sulfur side walls extending from a perimeter of the base layer, and bulk sulfur positioned on top of the base layer;

a top layer positioned at an extent of the side walls and comprising a first sub-layer formed from high strength sulfur, a second sub-layer formed from a rigid moisture resistant material, and a third sub-layer formed from top soil; and one or more hatches positioned at the top layer that provide access to the bulk sulfur of the intermediate layer.

2. The underground storage unit of claim 1, wherein the high strength sulfur side walls, the cells of the grid, and the first sub-layer are each formed from Pre-case Sulfur Concrete (PSC), Sulfur Extended Asphalt (SEA), or Sulfur-Asphalt-Sand (SAS).

3. The underground storage unit of claim 1, wherein the second sub-layer and the one or more hatches are formed from spoolable Reinforced Thermoplastic Pipes (RTP) or Flexible Composite Pipes (FCP).

4. The underground storage unit of claim 1, wherein the cells of the grid of the base layer are flexibly coupled to adjacent cells such that the base layer flexes in response to subsidence below or surrounding the underground storage unit.

5. The underground storage unit of claim 1, wherein the side walls are angled away from the base layer.

6. The underground storage unit of claim 5, further comprising a perimeter wall formed from high strength sulfur that encircles the top layer.

7. The underground storage unit of claim 6, further comprising a sulfur detection system that includes a plurality of detection sensors configured to sense sulfur and moisture in sensing wells extending beneath the perimeter wall.

8. The underground storage unit of claim 7, wherein the bulk sulfur comprises a plurality of sulfur cuboids aligned with the grid of cells, and the plurality of detection sensors are positioned at or near the sulfur cuboids within the intermediate layer.

9. An underground sulfur storage system comprising:

a project storage site located proximal to an oil and gas field comprising two or more underground storage units, each underground storage unit comprising:

a base layer having a substantially rectangular shape configured to flex, the base layer comprising leachate collection pipes arranged to form a grid of cells, wherein each cell is sealed with high strength sulfur;

an intermediate layer comprising high strength sulfur side walls extending from and tilted away from a perimeter of the base layer, and sulfur cuboids positioned on top of the base layer and aligned with the cells of the base layer;

a top layer spanning an extent of the side walls and comprising a first sub-layer formed from high strength sulfur, a second sub-layer formed from a rigid moisture resistant material, and a third sub-layer formed from top soil; and one or more hatches positioned at the top layer to provide access to the sulfur cuboids of the intermediate layer.

10. The system of claim 9, wherein the sulfur cuboids are formed at the project storage site by compacting bulk sulfur produced from sour hydrocarbon at the oil and gas field.

11. The system of claim 9, wherein the second sub-layer and the hatches are formed from spoolable Reinforced Thermoplastic Pipes (RTP) or Flexible Composite Pipes (FCP).

12. The system of claim 9, wherein the second sub-layer is formed from polyvinyl chloride (PVC).

13. The system of claim 9, wherein the cells are sealed with Sulfur Extended Asphalt (SEA) formed at a concrete and asphalt facility located at the project storage site.

14. The system of claim 13, wherein the high strength sulfur side walls and first sub-layer are formed from Pre-cast Sulfur Concrete (PSC) at the concrete and asphalt facility and the concrete and asphalt facility forms PSC and SEA from bulk Sulfur produced from sour hydrocarbon at the oil and gas field.

15. The system of claim 9, further comprising a perimeter wall formed from PSC that encircles the top layer and a portion of the side walls.

16. The system of claim 15, further comprising a sulfur detection system including a plurality of detection sensors configured to sense sulfur and moisture in sensing wells beneath the perimeter wall and between sulfur cuboids of the intermediate layer.

17. A method of building the underground sulfur storage system of claim 9 comprising:

laying high strength sulfur to form a base layer of a first storage unit of the project storage site, the base layer comprising a leachate collection system including a plurality of leachate collection pipes arranged to form a grid of cells, each cell being sealed with high strength sulfur;

laying high strength sulfur to form side walls extending from and tilted away from a perimeter of the base layer of the first storage unit;

storing bulk sulfur on top of the base layer and between the side walls of the first storage unit; and laying high strength sulfur spanning extents of the side walls to form a top layer and seal the first storage unit.

18. The method of claim 17, the method further comprising:

compacting bulk sulfur into sulfur cuboids at the project storage site;

storing the sulfur cuboids in the intermediate layer to align with the grid of cells of the base layer;

laying polyvinyl chloride (PVC) on top of the high strength sulfur of the top layer to resist acid and moisture; and accessing the sulfur cuboids on top of the base layer through a hatch positioned at the top layer.

19. The method of claim 17, further comprising flexing the base layer between a normal mode and a flexible mode in response to subsidence below or near the first storage unit.

20. The method of claim 19, wherein the project storage site further includes a second storage unit, the method further comprising:

assessing sulfur produced at the oil and gas field to determine a volumetric estimation of the sulfur of the first and second storage units;

analyzing land proximal to the oil and gas field to determine a location and size of a project storage site based on the volumetric estimation;

treating, via sulfur recovery unit, oil and gas produced by the oil and gas field to extract the sulfur as bulk sulfur;

processing, via a concrete and asphalt facility, bulk sulfur to form high strength sulfur; and transporting high strength sulfur and bulk sulfur to the project storage site.

* * * * *